US011655667B2

(12) United States Patent
Brockmüller et al.

(10) Patent No.: US 11,655,667 B2
(45) Date of Patent: May 23, 2023

(54) ADHESIVE JOINING AND REINFORCEMENT OF GLASS PACKETS IN SASH PROFILES

(71) Applicants: BASF SE, Ludwigshafen (DE); SIKA TECHNOLOGY AG, Baar (CH)

(72) Inventors: Kay Brockmüller, Neustadt (DE); Matthias Dick, Zufikon (CH)

(73) Assignees: BASF SE, Ludwigshafen (DE); SIKA TECHNOLOGY AG, Baar (CH)

( * ) Notice: Subject to any disclaimer, the term of this patent is extended or adjusted under 35 U.S.C. 154(b) by 0 days.

(21) Appl. No.: 17/263,439

(22) PCT Filed: Aug. 5, 2019

(86) PCT No.: PCT/EP2019/071038
§ 371 (c)(1),
(2) Date: Jan. 26, 2021

(87) PCT Pub. No.: WO2020/030601
PCT Pub. Date: Feb. 13, 2020

(65) Prior Publication Data

US 2021/0285275 A1 Sep. 16, 2021

(30) Foreign Application Priority Data

Aug. 9, 2018 (EP) ..... 18188303

(51) Int. Cl.
*E06B 3/22* (2006.01)
*E06B 3/54* (2006.01)
*E06B 3/56* (2006.01)

(52) U.S. Cl.
CPC ..... *E06B 3/223* (2013.01); *E06B 3/5454* (2013.01); *E06B 3/56* (2013.01); *E06B 2003/224* (2013.01)

(58) Field of Classification Search
CPC . E06B 3/08; E06B 3/105; E06B 3/221; E06B 3/222; E06B 3/223; E06B 3/24;
(Continued)

(56) References Cited

U.S. PATENT DOCUMENTS 2,883,718 A * 4/1959 Persson ..... E06B 3/64 52/209
3,667,179 A * 6/1972 Eisenberg ..... E06B 3/6621 52/209
(Continued)

FOREIGN PATENT DOCUMENTS

DE 8202221 U1 11/1982
DE 35 43 524 A1 6/1987
(Continued)

OTHER PUBLICATIONS

Nov. 5, 2019 International Search Report issued in International Patent Application No. PCT/EP2019/071038.
(Continued)

*Primary Examiner* — Kyle J. Walraed-Sullivan
(74) *Attorney, Agent, or Firm* — Oliff PLC

(57) ABSTRACT

A wing profile has a glass package including several glass plates, wherein the wing profile has a reinforcement element made of plastic, which substantially is mounted on the wing profile below the entire support surface of the glass package. Between the reinforcement element and the glass package, a cohesive connection is provided by a plurality of adhesive elements.

15 Claims, 1 Drawing Sheet

(58) Field of Classification Search
CPC ..... E06B 3/5454; E06B 3/56; E06B 3/5814; E06B 2003/224; E06B 2003/227; E06B 2003/228; E06B 2003/2637; E06B 2003/26372; E06B 2003/6232; E06B 2003/6273
See application file for complete search history.

(56) References Cited

U.S. PATENT DOCUMENTS 4,506,125 A * 3/1985 Smets ..... C03C 27/06 219/633
4,624,091 A * 11/1986 Biro ..... E06B 3/5821 52/204.593
4,850,168 A * 7/1989 Thorn ..... B29C 66/54 52/207
6,327,826 B1 * 12/2001 Mann ..... E06B 5/161 52/1
10,619,401 B2 * 4/2020 Krause ..... E06B 1/62
2002/0162278 A1 * 11/2002 Demars ..... E06B 1/6015 49/67
2002/0189743 A1 * 12/2002 Hornung ..... E06B 3/24 156/109
2005/0034386 A1 * 2/2005 Crandell ..... E06B 3/56 52/204.5
2005/0210824 A1 * 9/2005 Burton ..... E04F 21/0015 52/745.15
2011/0225893 A1 * 9/2011 Neukirchner ..... E06B 3/221 49/504
2013/0000232 A1 * 1/2013 Weiss ..... B32B 17/10293 52/204.6
2017/0030139 A1 * 2/2017 Rebree ..... E06B 3/221
2017/0081903 A1 * 3/2017 Saunders ..... E06B 3/549
2020/0340292 A1 * 10/2020 Ettridge ..... B32B 27/36

FOREIGN PATENT DOCUMENTS

DE 10 2014 014 658 A1 4/2016
EP 1510644 A2 * 3/2005 ..... E06B 3/308
FR 2708030 A1 * 1/1995 ..... E06B 3/66347
WO 2009/098068 A1 8/2009
WO WO-2012131375 A2 * 10/2012 ..... B32B 27/08
WO WO-2014026756 A1 * 2/2014 ..... E06B 3/22
WO 2014/184256 A1 11/2014

OTHER PUBLICATIONS

Feb. 9, 2021 International Preliminary Reporton Patentability issued in International Patent Application No. PCT/EP2019/071038.

* cited by examiner

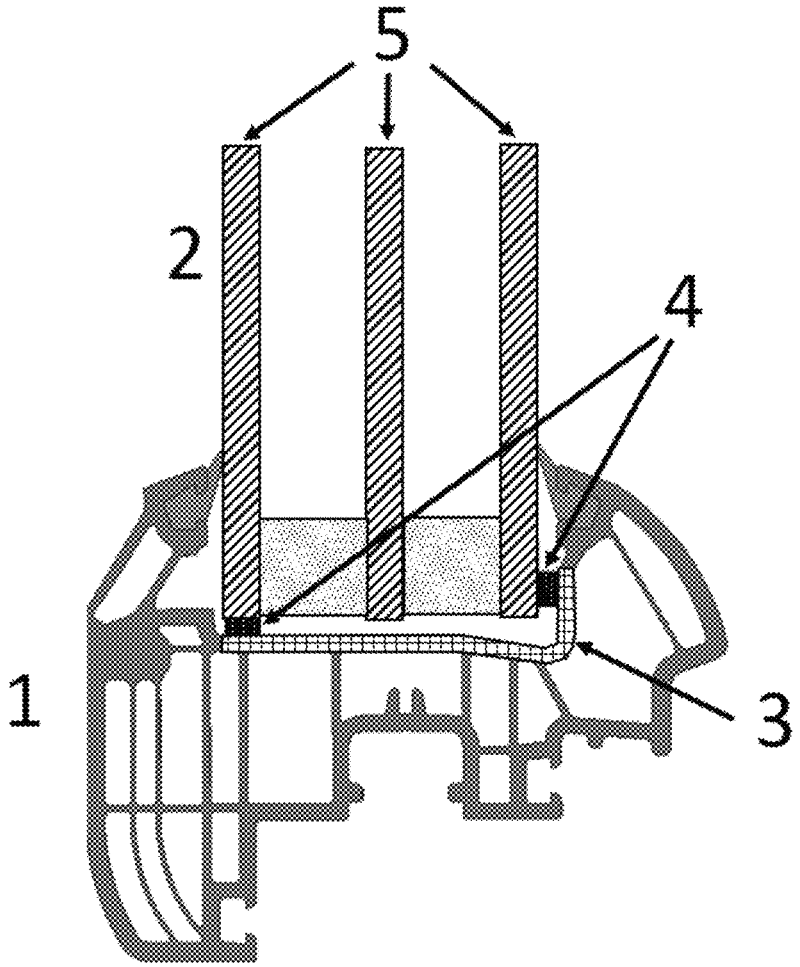
5
2
4
1
3

ADHESIVE JOINING AND REINFORCEMENT OF GLASS PACKETS IN SASH PROFILES

The present invention relates to sash profiles having a glass packet, wherein the sash profile has a reinforcing element which is composed of polymer and is installed essentially under the entire contact area of the glass packet and a substance-to-substance join between the reinforcing element and the glass packet is provided by means of an adhesive element. The present invention further relates to processes for producing such sash profiles and the use of the combination of adhesive elements and reinforcing elements to improve the flexural strength of sash profiles.

PRIOR ART

Sash profiles, in particular profiles in the form of multi chamber hollow profiles made of extruded thermoplastic polymers, are frequently used as window or door frame profiles. In modern window systems, there has for some time been a trend toward greater multiple glazing because of desired improvements in the thermal insulation properties, with triple glazing being standard today and 4-fold glazing not being unusual. As a result, such windows and doors are relatively heavy and wide because of the multiple glass layers.

However, owing to the hollow profile construction, which is intended to save weight and improve the insulating effect, such profiles are susceptible to flexural forces as a result of which the profile can distort or become damaged.

In order to improve the flexural strength of such hollow profiles without the thermal insulation effect being significantly impaired, it has been proposed in WO 2009/098068 A1 that the outer profile (i.e. the part of the profile which is joined to the facade) and inner profile (i.e. the part of the profile which is joined to the glass) be provided with reinforcing elements which are arranged vertically (i.e. parallel to the front and rear side visible in the installed state) in the hollow profiles.

In multiple glazing and especially triple or 4-fold glazing, a particular problem is the weight of the glass packet which acts from above on the hollow profile and can lead to vertical deformation of the hollow profile. This problem is not solved completely satisfactorily by the reinforcing elements described in WO 2009/098068 A1.

DE 10 2014 014 658 discloses reinforcing profiles for windows which comprise a glass packet and a reinforcing element installed underneath. The reinforcing element is joined to the glass packet by means of an adhesive strip.

DE 35 43 524 A1 discloses sash profiles having a glass packet and a glass block frame which is installed underneath and is fastened to the glass packet by means of silicone or butyl adhesive bonding. Here, the silicone adhesive bonding forms the room-side seal and the butyl adhesive bonding provides the weather-side seal. Such adhesives are generally comparatively soft and have moduli of elasticity of less than 10 MPa.

It was therefore an object of the present invention to propose a sash profile for door and window systems which in comparison with known systems has improved flexural stiffness under the action of external forces.

DESCRIPTION OF THE INVENTION

In a first aspect, the invention provides a sash profile having a glass packet comprising a plurality of glass plates, characterized in that the sash profile has a reinforcing element which is composed of polymer and is installed essentially in the entire contact area of the glass packet on the sash profile, where a substance-to-substance join between the reinforcing element and the glass packet is provided by means of at least two adhesive elements and the adhesive elements have an E modulus in accordance with ISO 37 (at 23° C. and 50% relative atmospheric humidity) of at least 100 $N/mm^2$.

In the context of the present invention, a "glass packet" is a plurality of glass sheets which are arranged on top of one another and may be separated from one another by spacers. In a glass packet, the glass sheets are generally fixed on top of one another in such a way that horizontal movement of one glass sheet relative to another glass sheet in the glass packet is not possible.

In the context of the present invention, a "sash profile" is the part of the profile which is in contact with the glass packet. Here, the term "sash profile" encompasses not only the entire profile surrounding the glass packet but also parts thereof, for example the upper or lower part or the side parts of the profile.

The contact area designates, for the purposes of the present invention, only the region in which the glass packet is in contact in the direction of its extension (i.e. not its thickness) with the sash profile.

For the present purposes, "essentially completely" means that the reinforcing element in the sash profile covers at least 70%, preferably at least 80% and even more preferably at least 90%, of the contact area of the glass packet on the sash profile. Here, the glass packet can project on the front side or rear side, so that no reinforcing element is arranged between the glass packet and the sash profile in this region. However, it is also possible for the reinforcing element to be absent at the ends of the profile or for the reinforcing element to be discontinuous, with the gaps being present between individual sections of the reinforcing element, or for the reinforcing element to have holes which form hollow spaces between the glass packet and the sash profile.

For the purposes of the present invention, preference is given to the reinforcing element being installed in the region of the entire contact area of the glass packet. Furthermore, the reinforcing element preferably has a greater extension than the contact area of the glass packet, so that it forms an overhang relative to the glass packet.

For the purposes of the present invention, preference is also given to the reinforcing element being angled so that part of the reinforcing element is arranged on the face side or rear side of the glass packet and another part of the reinforcing element is arranged on the underside of the glass packet. Further preference is given to the reinforcing element being angled so that part of the reinforcing element is arranged on the face side of the glass packet and another part of the reinforcing element is arranged on the underside of the glass packet. The angle is in this case advantageously about 90°.

The angled reinforcing element is particularly preferably L-shaped, i.e. one area of the reinforcing element is larger than the other area. For this purpose, preference is also given to the larger of the areas to be positioned under the glass packet and the smaller area to be positioned on the face side or rear side, preferably on the face side, of the glass packet. In such a construction, a favorable stiffness is found in the sash element both in the direction longitudinal to and transverse to the sash profile.

The "face side" of the glass packet is here the side of the window which is directed against a bead of the outer profile, while the "rear side" of the glass packet is that side which is opposite to this bead.

In the sash profile according to the invention, at least two adhesive elements are provided between the reinforcing element and the glass packet. Compared to the use of only one adhesive element, the use of material can in this way be reduced while maintaining a comparable stability.

Furthermore, preference is given to one of the adhesive elements of the sash profile being arranged in the region of the edge of the rear side between the glass packet and the reinforcing element. In this case, the adhesive element is arranged on the underside of the glass packet. Preference is likewise given to one of the adhesive elements of the sash profile having an adhesive element which is arranged in the region of the edge of the face side between the glass packet and the reinforcing element. In this case, it is particularly advantageous for the adhesive element to be arranged on the face side of the glass packet. A sash profile which has at least two adhesive elements, where one of these adhesive elements is arranged in the region of the edge of the rear side between the glass packet and the reinforcing element and one adhesive element is arranged in the region of the edge of the face side between the glass packet and the reinforcing element, is most preferred.

The present invention is not subject to any particular restrictions in respect of the reinforcing element, with the proviso that the material of the reinforcing element has to have a greater flexural strength than the material of which the hollow profile of the sash profile is made. The reinforcing element can accordingly be in principle made of any thermoplastically processable polymer. Such thermoplastically processable polymers are known per se to a person skilled in the art and have been frequently described in the prior art.

In particular, thermoplastic partially crystalline or amorphous polymers such as polyamides, in particular polyamide-6 and polyamide-6.6, polyethylene terephthalates and polybutylene terephthalates, polyoxymethylenes, polysulfones or polyether sulfones, also polyphenylene sulfides, polyethylenes, polypropylenes, polyvinyl chloride or styrene polymers and copolymers, e.g. acrylonitrile-butadiene-styrene, are suitable for producing the reinforcing element. Particularly suitable polymers are polyethylene terephthalates, polybutylene terephthalates and mixtures thereof.

The polymers mentioned can be used in pure form or as a mixture with the customary polymer auxiliaries known to a person skilled in the art. In a preferred embodiment, thermoplastic polymers provided with fibrous or particulate fillers are used. Suitable fillers are glass fibers, glass spheres, mineral fillers or nanoparticles. In particular, the thermoplastic polymers are reinforced with glass fibers. Thermoplastic polymers reinforced with glass fibers typically contain from 10 to 60% by weight, preferably from 20 to 60% by weight, particularly preferably from 40 to 55% by weight, glass fibers, where the percentages by weight are based on the total weight of the thermoplastic polymer and the glass fibers. Particularly suitable glass fibers have a length in the range from 1 μm to 1 cm, preferably in the range from 10 μm to 600 μm, particularly preferably in the range from 30 μm to 300 μm. The average length-to-diameter ratio of preferred glass fibers is in the region of 100:1, preferably 50:1, particularly preferably 30:1, in the component.

Preferred thermoplastic polymers for producing the reinforcing elements have an E modulus in accordance with testing standard ISO 527-1/-2 at 23° C. of >3000 N/mm$^2$, preferably >10 000 N/mm$^2$, a softening temperature of >50° C., preferably >100° C., particularly preferably >150° C., and a coefficient of thermal expansion of $<6\cdot10^{-5}$ K$^{-1}$, preferably $<5\cdot10^{-5}$ K$^{-1}$, most preferably $<4\cdot10^{-5}$ K$^{-1}$, measured at 23° C.

The reinforcing element is very particularly preferably produced from a thermoplastic polymer which is polybutylene terephthalate or a mixture of polyethylene terephthalate and polybutylene terephthalate and contains from 10 to 60% by weight, preferably from 20 to 60% by weight, particularly preferably from 40 to 55% by weight, glass fibers, where the percentages by weight are based on the total weight of the thermoplastic polymer and the glass fibers and the glass fibers have a length in the range from 1 μm to 1 cm, preferably in the range from 10 μm to 600 μm, particularly preferably in the range from 30 μm to 300 μm, and in the component have an average length-to-diameter ratio in the region of 100:1, preferably 50:1, particularly preferably 30:1, and at 23° C. have an E modulus of >3000 N/mm$^2$, preferably >10 000 N/mm$^2$, a softening temperature of >50° C., preferably >100° C., particularly preferably >150° C., and a coefficient of expansion of $<6\cdot10^{-5}$ K$^{-1}$, preferably $<5\cdot10^{-5}$ K$^{-1}$, most preferably $<4\cdot10^{-5}$ K$^{-1}$. A reinforcing element made of such a material makes it possible to ensure, in a suitable manner, that stresses in the glass under flexural loads do not exceed a measure which can be withstood by the glass sheet and fracture of the glass is thus prevented.

The reinforcing element can be formed exclusively by the abovementioned materials, but it can also have, for example, an envelope which is preferably formed by a polymer different from the thermoplastic polymer. A particularly suitable enveloping material is, for example, PVC (polyvinyl chloride). In addition, it is possible for the side of the reinforcing element which is joined to the adhesive element to be coated with a material which improves adhesion between adhesive element and the material of the reinforcing element. If the reinforcing element is, for example, made of a material which has a high proportion of glass fibers, the adhesion of an adhesive applied directly to such a material can be disadvantageously impaired. This disadvantage can be compensated for by a material which desirably adheres both to the reinforcing element and can form a good bond to the adhesive element.

Such an adhesion-promoting material can in principle be any material which mediates good adhesion between the reinforcing material and the adhesive elements. An adhesion-promoting material which is particularly suitable for this purpose is, for example, polyvinyl chloride (PVC). The reinforcing element and in particular a reinforcing element which is made of a thermoplastic polymer in the form of polybutylene terephthalate or a mixture of polyethylene terephthalate and polybutylene terephthalate containing a proportion of glass fibers of from 10 to 60% by weight, and preferably from 20 to 60% by weight, is therefore coated, in one embodiment, with a layer of PVC, in particular in a thickness in the range from 0.2 to 2 mm and preferably from 0.5 to 1 mm, on the side coming into contact with the adhesive elements. Such reinforcing elements can, for example, advantageously be produced by a coextrusion process. As an alternative, the reinforcing element can have a metallic layer as adhesion-promoting layer, and this is applied to the side of the reinforcing element which comes into contact with the adhesive elements, e.g. by means of a PVD process or other coating process.

For the purposes of the present invention, the adhesive element can be based on any suitable adhesive material which can be used for stable joining of the glass packet to the reinforcing element and which in the hardened state has an E modulus in accordance with ISO 37 (at 23° C. and 50% relative atmospheric humidity) of at least 100 N/mm$^2$.

Accordingly, both one-component and multicomponent adhesive compositions are possible for the adhesive element. In the context of the present invention, particular preference is given to a two-component adhesive composition, in particular a free-radically curable two-component (meth)acrylate adhesive composition. Such suitable adhesive compositions are, for example, described in WO 02/70620. In particular, the compositions are compositions based on tetrahydrofurfuryl (meth)acrylate or methyl (meth) acrylate. Suitable adhesives of this type are commercially available, for example, under the trade name SikaFast® from Sika Schweiz AG. Further suitable illustrative adhesives are commercially available under the trade names SikaPower® and SikaForce®.

Furthermore, materials which in the hardened state have an E modulus in accordance with ISO 37 (at 23° C. and 50% relative atmospheric humidity) of at least 160 N/mm$^2$ and preferably at least 200 N/mm$^2$ and/or not more than 2000 N/mm$^2$ and preferably not more than 1500 N/mm$^2$ are preferred for the adhesive element. Furthermore, a Shore A hardness in accordance with DIN 53505 of at least 60 can be indicated as suitable for the adhesive elements, at least 70 can be indicated as preferred and at least 80 can be indicated as more preferred. As a result of these properties, the adhesive element or elements has/have a favorable stiffness which in combination with the reinforcing element gives the sash profile an extremely advantageous flexural stiffness. On the other hand, these specifications ensure that the adhesive elements are sufficiently flexible in the event of temperature fluctuations, e.g. during transport, for stresses occurring as a result of a different expansion behavior of adhesive and glass to be attenuated and not to lead to cracks in the glass.

For the purposes of the present invention, glass packets having a relatively high weight can, in particular, also be used. Preference is therefore given to the glass packet to have at least three glass layers, more preferably 3 or 4 glass layers.

According to the above, the reinforcing element is joined by substance-to-substance bonding to the glass packet via the adhesive elements. Preference is given here to the reinforcing element being, in this join, joined directly to the adhesive material and coming into contact therewith, i.e. there is no other material such as material of the hollow profile of the sash element present between the reinforcing element and the adhesive material. Since the adhesive element is in the form of a plurality of adhesive elements, a hollow space can be formed in the region which is not covered by the adhesive elements.

Apart from the abovementioned reinforcing element, the sash profile can contain further reinforcing elements. For example, it is conceivable for there to be further reinforcing elements which are arranged in the region of the face side or rear side of the sash profile, on the outside or in the sash profile, as is depicted in FIG. 5 of WO 2009/098068 A1. It is likewise possible for one or more reinforcing elements to be arranged in an outer profile into which the sash profile is inserted. In this case, preference is given to the reinforcing element or elements running in the longitudinal direction through the outer profile, as is depicted in FIGS. 1 to 4 of WO 2009/098068 A1. Here, the additional reinforcing element or elements can be integrated vertically or in an inclined manner into the profile.

The material of which the additional reinforcing elements are made can be the same material or a different material as that of which the reinforcing element in the sash profile is made, but preference is given to this reinforcing element and additional reinforcing elements being made of the same material.

A further aspect of the present invention relates to a process for producing a sash profile, preferably as claimed in any of claims 1 to 13, comprising the following steps:

provision of a hollow profile, installation of a reinforcing element on the hollow profile, installation of a plurality of adhesive elements on the reinforcing element, where the adhesive elements (4) have an E modulus in accordance with ISO 37 (at 23° C. and 50% relatively atmospheric humidity) of at least 100 N/mm$^2$, and contacting of the plurality of adhesive elements with a glass packet to form a substance-to-substance join between the reinforcing element and the glass packet via the adhesive element.

Here, the order of the steps is not critical, except that the joining of the glass packet to the reinforcing element occurs last in the process. Preference is nevertheless given to installation of the reinforcing element on the hollow profile being carried out in an early stage of the production process, since in this case the hollow profile and the reinforcing element can be produced in one step, for example by co-extrusion.

Still another aspect relates to the use of a combination of adhesive elements and a reinforcing element for improving the flexural strength of a sash profile, wherein the glass packet is joined by substance-to-substance bonding via the adhesive elements to the reinforcing element arranged on the sash profile and the adhesive elements (4) have an E modulus in accordance with ISO 37 (at 23° C. and 50% relative atmospheric humidity) of at least 100 N/mm$^2$.

FIG. 1 schematically shows a sash profile according to the present invention. The sash profile 1 comprises a hollow profile having a reinforcing element 3 above which a glass packet 2 having three glass plates 5 is arranged. Two adhesive elements 4 are installed between the glass packet and the glass packet 2 is joined via these to the reinforcing element 3. In the region between these adhesive elements 4, there is a small hollow space between glass packet 2 and reinforcing element 3. The sash profile can be joined to an outer profile which likewise contains reinforcing elements (not shown).

In the following, the invention will be illustrated in more detail with the aid of working examples, but these are not to be interpreted in any way as restricting the scope of protection of the patent application.

EXAMPLES

The flexural stiffness of various glass sashes consisting of a PVC sash, a glass packet, a reinforcing element made of Ultradur and various adhesives was calculated by means of a finite element model (FEM). A structure having a typical silicone adhesive having an E modulus (in the cured state) of about 2 MPa was used as a basis for a reference sash. For sash profiles according to the invention, either a stiff adhesive having an E modulus (in the cured state) of about 100 MPa or an adhesive having an E modulus of 1000 MPa was used as basis. The adhesives should be installed on the glass packet as shown in FIG. 1.

Specifically, the calculations were based on the following structure:

Dimensions of the glass sheets: 2.0×1.0 m

Thickness of the two outer glass sheets: each 4 mm

Distances of the triple glass packet: 4 mm glass+16 mm air+4 mm glass+16 mm air+4 mm glass Thickness of the reinforcing element: 3 mm, E modulus 14 000 MPa Thickness of the adhesive: 3 mm, width 4 mm The sag of the glass sashes in the middle of the long and short sides of the glass sash on loading with a force of in each case 250 N during storage of the glass sash was calculated by means of a simplified finite element model. The results of these calculations are given in table 1 below:

TABLE 1

| E modulus of adhesive [MPa] | Sag [mm] | Ratio to adhesive E = 2 MPa |
|---|---|---|
| Flexure over the long side | | |
| 2 | 12.5 | |
| 100 | 2.1 | 6 |
| 1000 | 0.84 | 15 |
| Flexure over the short side | | |
| 2 | 2.95 | |
| 100 | 0.92 | 3 |
| 1000 | 0.36 | 8 |

The calculations show that, with the same structure of the composite, a significant reduction in the sag at the force introduction point is established when the E modulus of the adhesive is increased.

The invention claimed is:

1. A sash profile comprising:

a glass packet comprising a plurality of glass plates, a reinforcing element which is composed of polymer, and at least two adhesive elements, wherein the reinforcing element is installed at least partially under an entire contact area of the glass packet on the sash profile, the at least two adhesive elements are sandwiched directly between the reinforcing element and the glass packet to form a substance-to-substance join between the reinforcing element and the glass packet, the at least two adhesive elements have an E modulus of at least 100 N/mm$^2$, measured at 23° C. and 50% relative atmospheric humidity, and the at least two adhesive elements are based on a free-radically curable two-component acrylate or methacrylate adhesive composition.

2. The sash profile as claimed in claim 1, wherein the reinforcing element is angled so that a part of the reinforcing element is arranged on a face side of the glass packet and another part of the reinforcing element is arranged on an underside of the glass packet.

3. The sash profile as claimed in claim 1, wherein the reinforcing element is coated with an adhesion-promoting material on a side joined to the at least two adhesive elements.

4. The sash profile as claimed in claim 1, wherein one of the at least two adhesive elements is arranged in a region of an edge of a rear side of the glass packet between the glass packet and the reinforcing element.

5. The sash profile as claimed in claim 1, wherein one of the at least two adhesive elements is arranged in a region of an edge of a face side of the glass packet between the glass packet and the reinforcing element.

6. The sash profile as claimed in claim 1, wherein the reinforcing element comprises a thermoplastic polymer.

7. The sash profile as claimed in claim 6, wherein the reinforcing element further comprises fibers.

8. The sash profile as claimed in claim 7, wherein the reinforcing element further comprises the fibers in an amount of from 10 to 60% by weight.

9. The sash profile as claimed in claim 6, wherein the thermoplastic polymer is enveloped by a material which is made of a polymer which is different from the thermoplastic polymer.

10. The sash profile as claimed in claim 1, wherein at least one of the at least two adhesive elements has an E modulus of at least 160 N/mm$^2$, measured at 23° C. and 50% relative atmospheric humidity.

11. The sash profile as claimed in claim 1, wherein the glass packet has at least three glass layers.

12. The sash profile as claimed in claim 1, wherein the reinforcing element is joined directly via the at least two adhesive elements to the glass packet and there is optionally a hollow space adjoining the reinforcing element in a direction of the glass packet.

13. A process for producing the sash profile, as claimed in claim 1, the process comprising:

providing a hollow profile, installing the reinforcing element on the hollow profile, installing the at least two adhesive elements on the reinforcing element, and contacting the at least two adhesive elements with the glass packet to form the substance-to-substance join between the reinforcing element and the glass packet via the at least two adhesive elements.

14. A method comprising:

applying a combination of adhesive elements and a reinforcing element to a sash profile, wherein the adhesive elements are sandwiched directly between the reinforcing element and a glass packet of the sash profile to form a substance-to-substance join between the reinforcing element and the glass packet, the adhesive elements have an E modulus of at least 100 N/mm$^2$, measured at 23° C. and 50% relative atmospheric humidity, and the adhesive elements are based on a free-radically curable two-component acrylate or methacrylate adhesive composition.

15. The sash profile as claimed in claim 1, wherein the reinforcing element covers at least 70% of the entire contact area of the glass packet on the sash profile.

* * * * *